United States Patent [19]

Egger

[11] Patent Number: 4,804,182

[45] Date of Patent: Feb. 14, 1989

[54] SPINNING BALL BOWLING

[76] Inventor: Ernst S. Egger, 762 Turner Rd., Kelowna, B.C., Canada, V1W 2K8

[21] Appl. No.: 906,266

[22] Filed: Sep. 9, 1986

[51] Int. Cl.[4] ..... A63D 1/00; A63D 3/00

[52] U.S. Cl. ..... 273/37; 273/64

[58] Field of Search ..... 273/37, 38, 82 R, 128 R, 273/128 CS, 64, 428

[56] References Cited

U.S. PATENT DOCUMENTS

| | | | |
|---|---|---|---|
| 107,545 | 9/1870 | Robinson | 273/38 |
| 1,030,834 | 6/1912 | Sawyer | 273/82 R |
| 2,754,122 | 7/1956 | Barnes | 273/37 |

FOREIGN PATENT DOCUMENTS

| | | | |
|---|---|---|---|
| 475607 | 11/1951 | Canada | 273/38 |
| 263309 | 11/1949 | Switzerland | 273/37 |
| 2132093 | 7/1984 | United Kingdom | 273/428 |

*Primary Examiner*—Anton O. Oechsle

[57] ABSTRACT

Apparatus for playing a game comprising a playing area, bounded by walls to define a longitudinal playing surface or alley. The playing surface has a target area at one end and at the opposite end a launching area for launching spinnable members. A plurality of target members are positioned at the target end of the playing surface. A spinnable member comprises an essentially spherical body having an axis of rotation and having a longitudinal member aligned with the axis of rotation extending from the essentially spherical body whereby the longitudinal member is used to impart spin to the spinnable member. The spinnable member is launched from the launching area and travels along the playing surface to the target area in order knock down target members and score points.

12 Claims, 8 Drawing Sheets

SPINNING BALL BOWLING

FIELD OF THE INVENTION

This invention relates to a game similar to bowling in which spinnable members are directed along a playing surface to knock down pins in order to score points.

SUMMARY OF THE INVENTION

Bowling is a popular sport which involves knocking down pins positioned in a specific pin layout at one end of a bowling alley using a bowling ball.

The present invention is a game patterned along the lines of bowling which uses a reduced playing area. Any conventional bowling game from three pin to fifteen pin may be played. The game of the present invention does not use the spherical ball of conventional bowling as such a projectile is unsuitable for the smaller playing surface. Using a spherical ball, a player cannot use his full throwing power, and it is difficult to control and moderate the throwing force resulting in poor ball control and unpredictable aiming. The game of the present invention uses a spinnable member to replace the conventional bowling ball.

Accordingly, the present invention is an apparatus for playing a game comprising in combination:

a playing area bounded by walls to define a longitudinal playing surface or alley having at one end a target area and at the opposite end a launching area to launch spinnable members;

a plurality of target members positioned in the target area of said playing surface;

a spinnable member comprising an essentially spherical body having an axis of rotation and having a longitudinal member aligned with said axis of rotation extending from said essentially spherical body whereby the longitudinal member is used to impart spin to said spinnable member such that said spinnable member is launched from said launching area and travels along said playing surface to said target area in order that said spinnable member may strike a target member.

Various embodiments of the spinnable member are provided having different spinning characteristics so that the game may be played by persons having different skill levels. By applying a spinning force to the spinnable member, it can be delivered to the target members under complete control of the user.

BRIEF DESCRIPTION OF THE DRAWINGS

Various embodiments of the present invention are illustrated, merely by way of example, in the following drawings in which.

DESCRIPTION OF THE PREFERRED EMBODIMENTS

Figure 15:
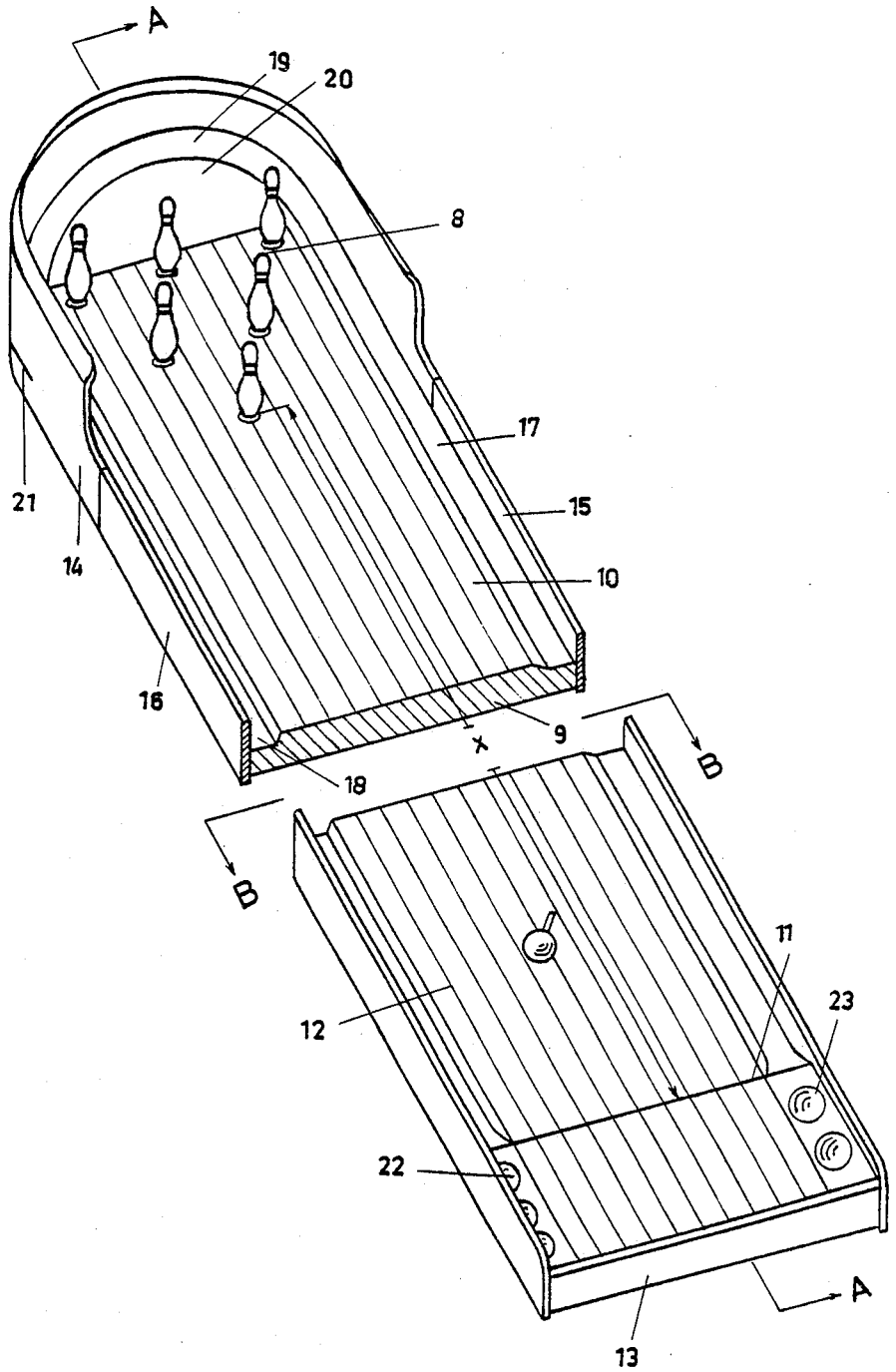
FIG. 15 is a perspective view of an embodiment of the present invention.
Figure 16:
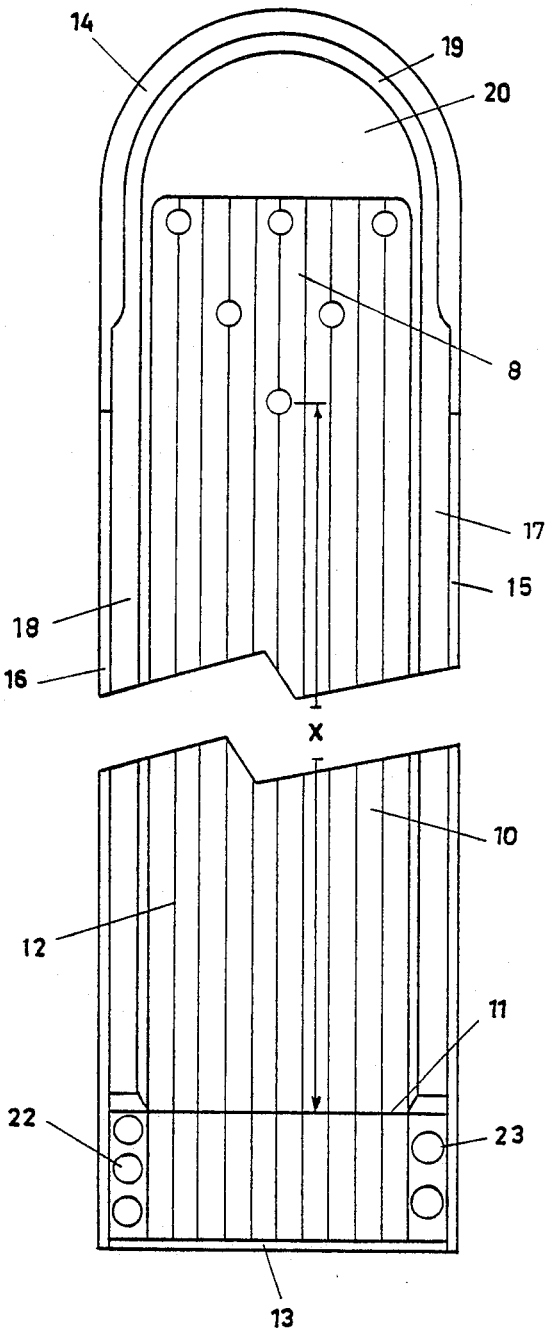
FIG. 16 is a plan view of the embodiment of FIG. 15.
Figure 18:
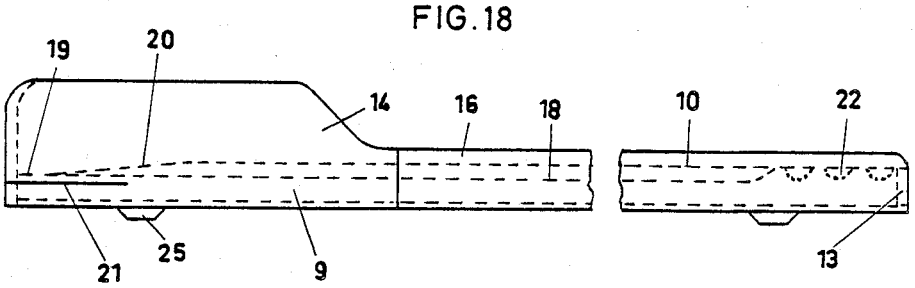
FIG. 18 is an elevation view of the embodiment of FIG. 15.
Figure 21:
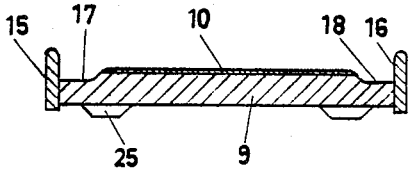
FIG. 21 is a section view taken along line B—B of FIG. 15.
Figure 22:
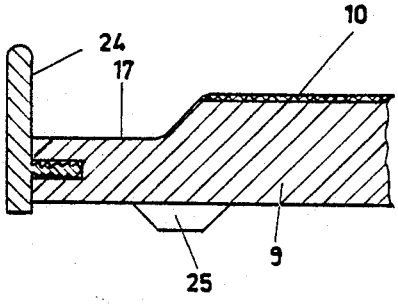
FIG. 22 is a detailed section view showing an alternative method of attaching the alley side walls.

The game of the present invention is played using the apparatus of FIG. 15 comprising an enclosed playing surface 10 surrounded by barriers to define a modified bowling alley. Playing surface 10 is mounted atop a support base 9 and extends from a launching area adjacent end board 13 to a target area at the opposite end. Playing surface 10 is marked by foul line 11 that defines the upper boundary of the launch area. As well, playing surface 10 is marked by board joint markings 12 extending longitudinally down the length of the playing surface to assist a player in aiming a spinnable member. In the target area, the playing surface is marked with pin position layout 8 to assist in accurate placement of the target members. Directly behind the target area is located sloping surface 20 where toppled target members are contained. This sloping surface 20 is best shown in FIG. 18. The playing surface 10 can be the painted and varnished upper surface of the support base 9, or a separate, plastic sheet with all the necessary markings that is attached to support base 9. The latter arrangement is shown in FIGS. 21 and 22. Support base 9 may be constructed from particle board or laminated hardwood.

Figure 19:
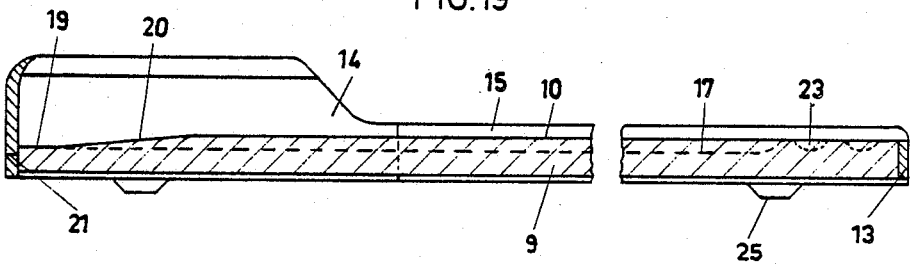
FIG. 19 is a section view taken along line A—A of FIG. 15.
Figure 20:
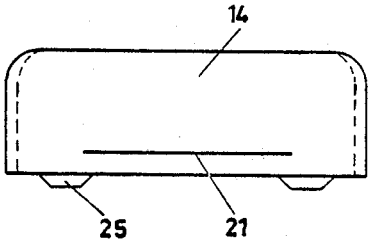
FIG. 20 is a end view of the embodiment of FIG. 15.

Side walls 15 and 16 extend along the edges of the support base 9 from end board 13 to the beginning of the target area. Target area is surrounded on three sides by a movable, flexible end wall 14 that is higher than the side walls 15 and 16. As best shown in FIGS. 18 and 19, wall 14 has an inwardly curving upper edge to assist in containing pins and spinnable members on the playing surface 10. End wall 14 serves to deflect spinnable members and absorb the impact of collision. To perform this impact absorbing function, end wall 14 can be constructed from plastic or hard synthetic rubber. End wall 14 is not attached to support base 9 along the entire lower perimeter of the wall to allow relative movement between the two. In another embodiment, end wall 14 is attached to support base 9 along its full length being formed with a slit 21 extending about the base of the wall and above which the end wall is not attached to base support 9. Such a slit can be cut to various lengths to allow end wall 14 to move more freely when absorbing impacts. The length of the cut will depend on the material of the end wall and the weight of the spinnable member. Side walls 15 and 16 can also be formed from plastic or hard synthetic rubber or they may be constructed from wood. In the event that end wall 14 and side walls 15 and 16 are constructed from the same flexible material, the walls may be formed in a single piece.

The walls of the present apparatus are separated from the playing surface 10 by channels 17 and 18 extending along the side edges of the playing surface and curved channel 19 extending about three sides of the target area. Adjacent end wall 13, these channels are formed into a series of depressions 22 and 23 in order to hold spinnable members that are not in play.

As shown in FIG. 21, side walls 15 and 16 and end wall 13 may be attached directly to support base 9. Alternatively, as shown in FIG. 22, side walls 24 may be used being formed with a tongue extending along the length of the wall for engagement in a corresponding groove formed in support base 9.

As shown in FIG. 19, support base 9 is mounted on rubber feet 25 in order to support the apparatus on a table top. For a free standing apparatus, fixed or folding legs may be attached to support base 9.

Figure 17:
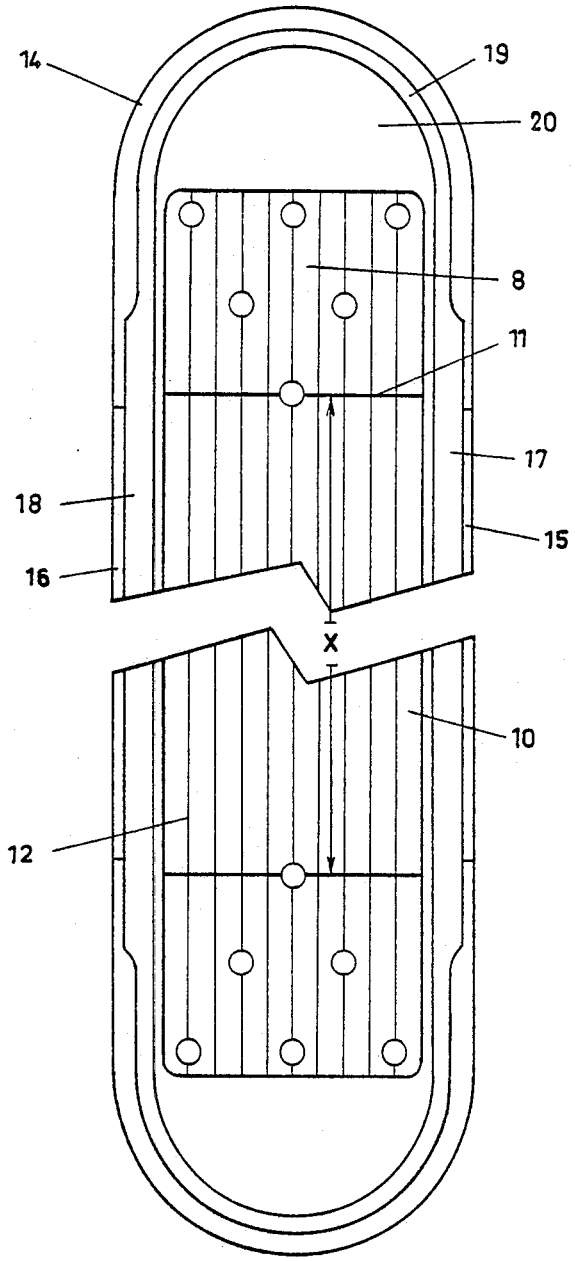
FIG. 17 is a plan view of another embodiment of the present game having two target areas at opposite ends.

Another embodiment of the apparatus is shown in FIG. 17 and comprises a playing surface having two target areas at opposite ends of the playing surface. Such an embodiment is suitable for larger playing surfaces and having target areas at both ends makes it possible to play the game from either end. A foul line 11 is drawn through the apex of each pin layout to define a launching area at each end.

Figure 12:
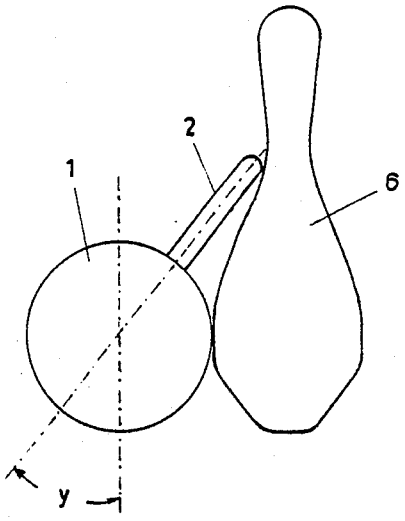
FIG. 12 shows a spinnable member contacting a pin.
Figure 13:
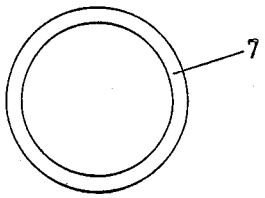
FIG. 13 is bottom view of the pin ring that may be used with the pin of FIG. 12.

Target area 20 is marked with pin position layouts 8 to assist in placing a number target members which may be of any desirable shape, size and weight. Target members may also comprise scale models of conventionally shaped bowling pins 6 as shown in FIG. 12. FIG. 13 shows such a scale model pin equipped with an optional pin ring 7 made from hard rubber, and slightly undersized for a friction fit about the pin 6. Target members can be made from a variety of hard and softwoods or of plastic. Wooden pins can be plastic coated or painted and varnished with a paint and varnish that has good elasticity.

Figure 14:
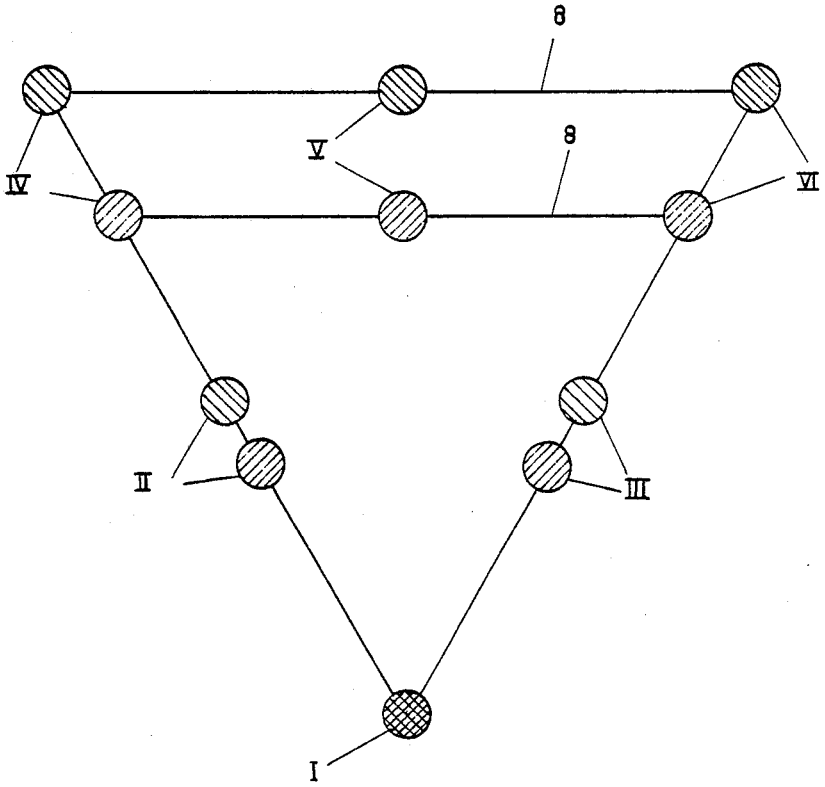
FIG. 14 shows pin position layouts for setting up a two sixpin arrangements of the present game.
Figure 23:
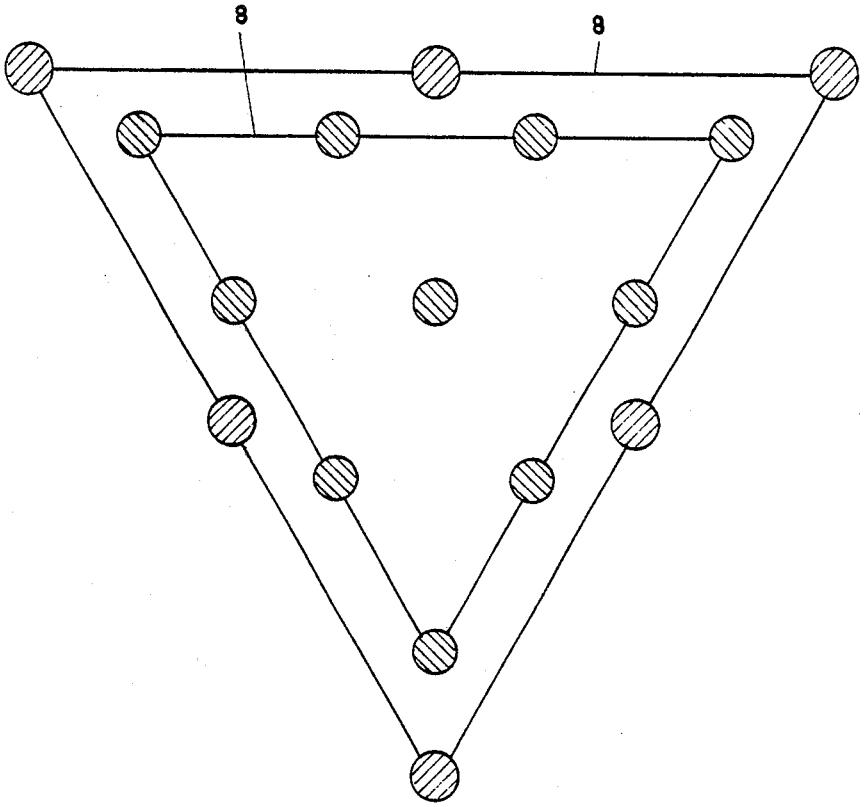
FIG. 23 shows a pin position layout.

Examples of pin position layouts are shown in FIGS. 14 and 23. In FIG. 14, two triangular pin position layouts are superimposed for play with six pins. Positions marked with hatching inclined to the left comprise a larger pin layout while those positions marked with hatching inclined to the right comprise a smaller pin layout. The lower apex position is used with both layouts. The smaller layout is easier to play as the smaller distance between the pins makes it more likely that pins will knock each other down. In FIG. 23, a staggered pin position layout 8 is shown. Using such a staggered layout, various spinning ball bowling games can be played using the same playing surface. In the pin layout of FIG. 23, a sixpin layout surrounds a tenpin layout. Each layout pattern may be marked with a different colour to easily distinguish one from the other.

Various embodiments of spinnable members for use with the present game are shown in FIGS. 1 to 11. The spinnable member comprises an essentially spherical body having an axis of rotation and having a longitudinal member aligned with said axis of rotation. A player uses the longitudinal member to impart a spin to the spinnable member. By taking into consideration the shape of the essentially spherical body and by varying the inclination of the longitudinal member from the vertical and controlling the amount of spin given to a spinnable member, a player can control the tracking path of the spinnable member down the playing surface. The more skillful and experienced a player, the greater his control of the spinnable member and the more accurate his aiming of the device in order to knock down target members.

In all embodiments of the spinnable member, essentially spherical body 1 can be made from any strong impact proof material such as various hardwoods, certain plastics or even steel. The body 1 can also be made from a composite of materials such as a plastic ball with a glass or metal core.

In constructing the spinnable members, it is important that longitudinal member 2 be alinged with a rotation axis of the essentially spherical body in order to create a balanced spinnable member.

In all embodiments of the spinnable member, longitudinal member 2 may be formed integrally with essentially spherical body 1 or the longitudinal member maybe separately attached. If separately attached, the longitudinal member may be constructed from the same material as the ball or a different material, and the member may be suitably attached using a threaded member and a correspondingly threaded cavity or by gluing the member into a cavity in the essentially spherical body 1.

Figure 1:
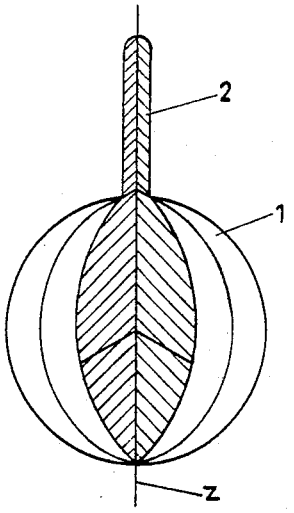
FIG. 1 is an embodiment of a spinnable member of the present invention.
Figure 2:
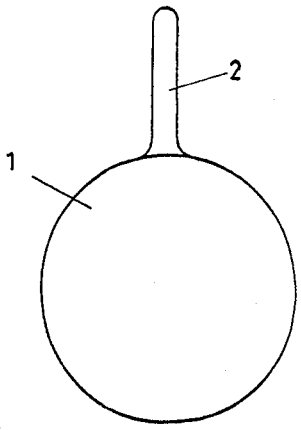
FIG. 2 is a further embodiment of a spinnable member of the present invention.
Figure 3:
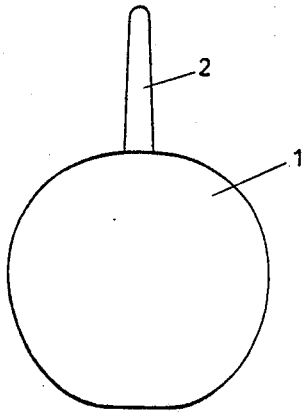
FIG. 3 is a further embodiment of a spinnable member of the present invention.
Figure 4:
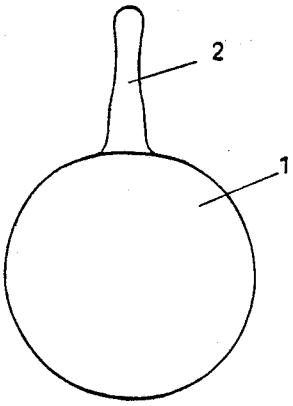
FIG. 4 is a further embodiment of a spinnable member of the present invention.
Figure 5:
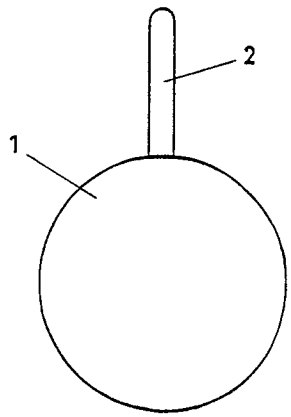
FIG. 5 is a further embodiment of a spinnable member of the present invention.

Longitudinal member 2 can comprise a cylindrical member as shown in FIG. 1 or the member can be tapered from a narrowed free end to a thickened portion to be received in body 1 as shown in FIG. 3. Additionally, longitudinal member 2 can be formed with sections of reduced diameter as shown in FIG. 4 to allow for better gripping, or it may be formed with a flared portion where the member joins the body 1 as shown in FIG. 2.

The various embodiments of the spinnable members shown in FIGS. 1 to 11 represent possible combinations of essentially spherical bodies 1 with longitudinal members 2. The tracking characteristics of a spinnable member are determined primarily by the shaped of the essentially spherical body and the inclination of the longitudinal member 2 whern the spinnable member is released. Angle y in FIG. 12 indicates the inclination angle and measures the angle of the longitudinal member to a vertical plane throgh the essentially spherical body. The maximum inclination angle y that can be used with a spinnable member will depend on the size and shape of the essentially spherical body 1 and the target member and the length of the longitudinal member 2. Ideally, a spinnable member should not be run at an inclination angle greater than the angle where the widest part of the target member and the spinnable member just make contact while the longitudinal member 2 simultaneously touches the targe member. Such a situation is shown in FIG. 12.

In the spinnable member embodiment illustrated in FIG. 1, the essentially spherical body comprises a sphere 1 to which is attached longitudinal member 2 aligned along a rotational axis z of sphere 1. Such a spinnable member will track in a straight line within an inclination range of the longitudinal member from about 15 degrees to 90 degrees from the vertical. The spinnable member can be made to curve left or right by vigourously following through with the hand to the left or right respectively while spinning and releasing the spinnable member.

FIGS. 2, 3, 4 and 5 show further embodiments of a spinnable member that use a body 1 which is non-spherical. In FIGS. 2–5, the non-spherical nature of body 1 creates dependent on the shape of body 1 and the inclination of longitudinal member 2 when the spinnable member is released. A major part of the skill required for playing the game of the present invention involves learning how to predict and control the tracking characteristics of a spinnable member such that the member can be aimed accurately at the target members.

Figure 6:
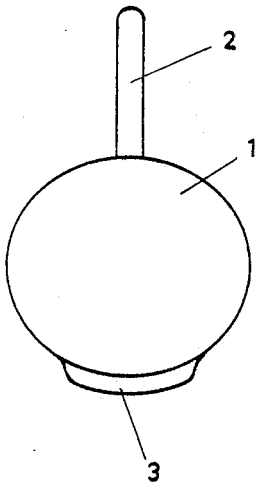
FIG. 6 is a further embodiment of a spinnable member of the present invention having an attached cup.
Figure 7:
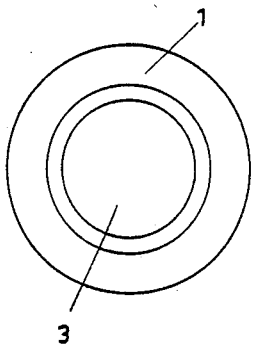
FIG. 7 is an end view of the embodiment of FIG. 6.

In the spinnable member embodiment of FIGS. 6 and 7, essentially spherical body 1 is formed with a cup 3 attached to its lowered surface opposite longitudinal member 2. Cup 3 can be formed with a diameter that is approximately $\frac{1}{3}$ to $\frac{2}{3}$ the diameter of the essentially spherical body 1. If the cup is smaller aiming becomes unpredictable, if it is larger, the cup has no effect on the tracking characteristics of the member. Cupped spinnable members are very maneuverable and respond quickly to small changes of inclination.

Figure 8:
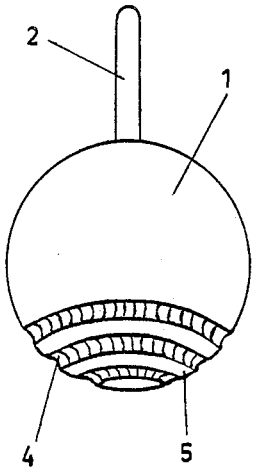
FIG. 8 is a further embodiment of a spinnable member of the present invention having grooves.
Figure 9:
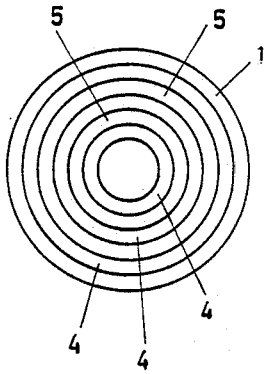
FIG. 9 is an end view of the embodiment of FIG. 8.

In the spinnable member embodiment of FIGS. 8 and 9, essentially spherical body 1 is formed with annular grooves 4 in the lower hemisphere of the body 1 opposite longitudinal member 2 to create rings 5. Such a modification gives the spinnable member better stability at certain inclinations.

Figure 10:
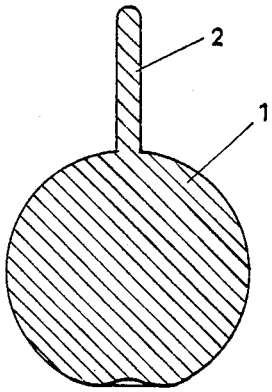
FIG. 10 is a further embodiment of a spinnable member of the present invention.
Figure 11:
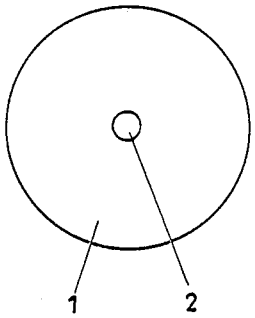
FIG. 11 a top view of the embodiment of FIG. 10.

In the spinnable member embodiment of FIGS. 10 and 11, essentially spherical body 1 is formed with a concave cavity at its lower end opposite longitudinal member 2.

Playing the game of the present invention is very similar to bowling. A player uses a spinnable member launched from behind the foul line 11 of the launching area to knock down target members in the target area in order to score points.

By way of example, a sixpin spinning ball bowling game is scored in the following manner:

The pin positions I and V of FIG. 14 count 5 points each, the pin positions IV and VI count 3 points each, and pin positions II and III count two points each for a total of 20 points.

Three spinnable members are delivered per set with oneexception which will be explained.

Ten sets make up one game.

A knock-down of all target members with one spinable member is a hit and counts 20 points plus 10 bonus points for a total of 30 points.

If the second spinnable member also scores a hit, the third spinnable member cannot be used. The maximum total set score is then 60 points.

If the second spinnable member does not score a hit, the points scored by the second and third spinnable member are added to the 30 points of the hit to obtain the set score.

If all target members are knocked down with the first two spinnable members, it is called a two-hit. All target members are reset and the third spinnable member is delivered. The set score is the total points scored by the three spinnable members.

A shot that knocks down all target members but the V target member is called an ace. If V target member is knocked down withthe second or third spinnable member, 5 bonus points are added to the set score.

If, after the first spinnable member has been delivered, only the IV, V and VI target members remain standing, these are called the three candles. If the next two spinnable members knock down the V target member and either the IV or VI target member, the remaining standing 3 point target member may also be counted for a set score of 20 points.

The scoring symbols used in the game are illustrated in

Figure 24:
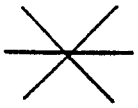
FIGS. 24 to 28 show scoring symbols used in the game.

FIGS. 24 through 28 in which:

FIG. 24 is the symbol for a hit.

Figure 25:
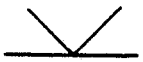

FIG. 25 is the symbol for two-hit.

Figure 26:
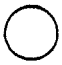

FIG. 26 is the symbol for an ace.

Figure 27:
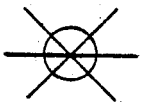

FIG. 27 is the symbol for a hit and an ace.

Figure 28:
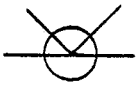

FIG. 28 is the symbol for a two-hit and an ace scored in the same set.

It is understood that the game of the present invention can be played on different sized playing surfaces by varying the dimensions of the playing surface 10, the target member and the spinnable member.

The dimensions of the playing surface 10 are determined by the length x as shown in FIG. 15 which is the distance between foul line 11 and the first target member position, the target member height and the size of the spinnable member.

The target member height determines the spacing of the pin position layout 8. The width of playing surface 10 is determined by the spacing of the pin position layout plus the sum of the width of two target members or two outside diameters of a pin ring 7.

The width and depth of channels 17, 18, and 19 and the height of side walls 15 and 16 are determined by the size of the spinnable member. For example, the width of channels 17, 18 and 19 can be the length of the spherical body's diameter and the depth of the channels can be 1/5 of the body's diameter. The height of side walls 15 and 16 as measured from the base of the channels can be twice the channel's depth or $\frac{1}{3}$ of the spherical body's diameter whichever is greater.

Preferably, the height of end wall 14 measured from the base of channel 19 is $\frac{3}{4}$ to the full height of the target members, or the end wall is of such a height that the longitudinal member 2 of the spinnable member does not get caught under the curved edge of the end wall 14.

As a general guideline, for playing surfaces where length x is 120 cm or less, the launching area can be 10 cm long as measured from end board 13 to foul line 11. For longer playing surfaces, a launching area length of 15 to 20 cm is recommended.

To choose a particular arrangement of the apparatus of the present invention and to size, proportion and co-ordinate the various components is a matter of personal preference. However, a number of factors that influence the playing characteristics and the sizing of the apparatus should be considered. The main factors affecting the playing characteristics and sizing of the apparatus of the present invention are: the shapes of the spinnable members, the centre to centre distance of the target members on the pin position layout 8, the playing length x, and the target member height, width and weight.

The most important factor affecting the playing characteristics of the game of the present invention is the shape of the spinnable member. By keeping all other factors the same, the game of the present invention may be played at a desirable skill level by selecting an appropriately shaped spinnable member.

The ease or difficulty of knocking over the target members is directly affected by the centre to centre distance of the pin position layout 8. The shorter this distance, the easier it is to score points as falling target members will tend to knock over adjacent target members. By way of example, it has been found that for a sixpin bowling game according to the present invention, the ratio of the centre to centre distance between pins to the pin height is preferably from 1.2:1 to 1.5:1.

The longer the length x of playing surface 10, all other factors such as the spinnable member, the target member and the pin position layout being held constant, the greater the required playing skill.

Ideally, the diameter of the widest part of the target member determines the diameter of the essentially spherical body of the spinnable member. For a sixpin bowling game, it has been found that a spinnable member diameter to target member diameter of between 1.18:1 to 1.25:1 works well.

Target member weight determines the weight of the spinnable member. For a sixpin bowling game, it has been found that a spinnable member weight to a target member weight ratio of between 1.75:1 to 2:1 works well.

As a guideline for sizing and proportioning a game according to the present invention, the table below gives the ranges for the length x of playing surface 10 with corresponding ranges of target member heights and weights. From this data, all other measurements can be derived to create a spinning ball bowling game according to the present invention that uses any number of target members.

| PLAYING SURFACE LENGTH range in cm | TARGET MEMBER HEIGHT range in cm | TARGET MEMBER WEIGHT range in g |
|---|---|---|
| 60–90 | 5–5.5 | 3–6 |
| 70–100 | 5.5–6 | 4–8 |
| 80–110 | 6–6.5 | 5–10 |
| 90–140 | 6.5–7 | 5–12 |
| 110–160 | 7–7.5 | 6–15 |
| 120–180 | 7.5–8 | 8–18 |
| 140–240 | 8–8.5 | 10–22 |
| 160–280 | 8.5–9 | 12–30 |
| 180–320 | 9–9.5 | 15–32 |
| 200–400 | 9.5–10 | 18–36 |

I claim:

1. Apparatus for playing a game comprising in combination:

a playing area bounded by walls to define a longitudinal playing surface or alley having at one end a target area and at the opposite end a launching area to launch spinnable members;

a plurality of target members positioned in the target area in a free standing array on said playing surface;

a spinnable member comprising an essentially spherical body having an axis of rotation and having a longitudinal member aligned with said axis of rotation extending from said essentially spherical body whereby the longitudinal member is used to impart spin to said spinnable member such that said spinnable member is launched from said launching area and travels along said playing surface to said target area in order that said spinnable member may strike one or more of said target members.

2. Apparatus as claimed in claim 1, in which said target members comprise conventionally shaped bowling pins.

3. Apparatus as claimed in claim 1, in which said essentially spherical body of said spinnable member is a sphere having said longitudinal member aligned with a diameter of the sphere.

4. Apparatus as claimed in claim 1, in which said essentially spherical body of said spinnable member has a flattened surface opposite said longitudinal member.

5. Apparatus as claimed in claim 1, in which said essentially spherical body of said spinnable member is formed with annular grooves to define annular rings about the lower hemisphere of the body opposite said longitudinal member.

6. Apparatus as claimed in claim 1, in which said essentially spherical body of said spinnable member is formed with a protruding cup member on the surface opposite said longitudinal member.

7. Apparatus as claimed in claim 1, in which said essentially spherical body of said spinable member is formed with a concave cavity on the surface opposite said longitudinal member.

8. Apparatus as claimed in claim 1, in which said longitudinal member comprises a cylinder.

9. Apparatus as claimed in claim 1, in which said longitudinal member comprises a tapered cylinder.

10. Apparatus as claimed in claim 1, in which said longitudinal member is formed with a flared end where it joins said essentially spherical body.

11. Apparatus as claimed in claim 1, in which said playing area wall is formed into a movable, flexible wall about said target area.

12. Apparatus as claimed in claim 11, in which said movable flexible wall curves inwardly along its upper edge.

* * * * *